US007967409B2

(12) United States Patent
Matsuura

(10) Patent No.: US 7,967,409 B2
(45) Date of Patent: Jun. 28, 2011

(54) RECORDING APPARATUS AND CONTROL METHOD

(75) Inventor: Shingo Matsuura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 161 days.

(21) Appl. No.: 12/485,802

(22) Filed: Jun. 16, 2009

(65) Prior Publication Data

US 2009/0315936 A1 Dec. 24, 2009

(30) Foreign Application Priority Data

Jun. 19, 2008 (JP) ..... 2008-160770

(51) Int. Cl.
*B41J 29/393* (2006.01)
*B41J 29/38* (2006.01)

(52) U.S. Cl. ..... 347/19; 347/12; 347/14

(58) Field of Classification Search ..... 347/12, 347/14, 19
See application file for complete search history.

(56) References Cited

U.S. PATENT DOCUMENTS

2003/0001914 A1* 1/2003 Matsumoto et al. ..... 347/12
2007/0064029 A1* 3/2007 Edwards et al. ..... 347/8

FOREIGN PATENT DOCUMENTS

JP 2005-088439 A 4/2005

* cited by examiner

*Primary Examiner* — Matthew Luu
*Assistant Examiner* — Jannelle M Lebron
(74) *Attorney, Agent, or Firm* — Canon USA Inc. IP Division

(57) ABSTRACT

With a recording apparatus and a control method of the recording apparatus, a pattern is recorded, and the pattern is used for determining whether a recording position is deviated. Only when it is determined that the recording position is deviated, a plurality of patterns are additionally recorded and an adjustment value is acquired.

7 Claims, 7 Drawing Sheets

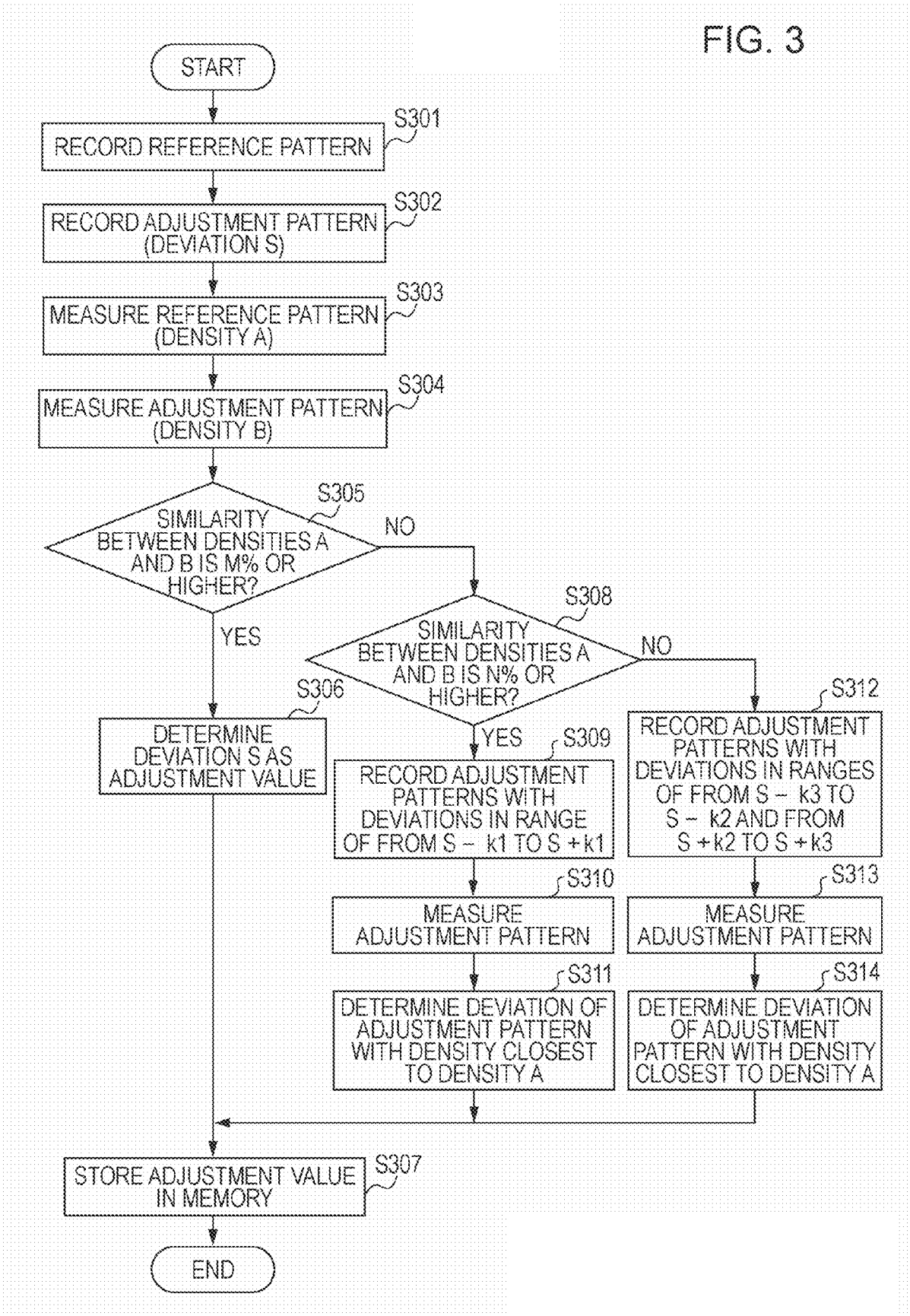
FIG. 3
START
RECORD REFERENCE PATTERN
S301
RECORD ADJUSTMENT PATTERN (DEVIATION S)
S302
MEASURE REFERENCE PATTERN (DENSITY A)
S303
MEASURE ADJUSTMENT PATTERN (DENSITY B)
S304
SIMILARITY BETWEEN DENSITIES A AND B IS M% OR HIGHER?
S305
NO
YES
SIMILARITY BETWEEN DENSITIES A AND B IS N% OR HIGHER?
S308
NO
YES
DETERMINE DEVIATION S AS ADJUSTMENT VALUE
S306
RECORD ADJUSTMENT PATTERNS WITH DEVIATIONS IN RANGE OF FROM S − k1 TO S + k1
S309
RECORD ADJUSTMENT PATTERNS WITH DEVIATIONS IN RANGES OF FROM S − k3 TO S − k2 AND FROM S + k2 TO S + k3
S312
MEASURE ADJUSTMENT PATTERN
S310
MEASURE ADJUSTMENT PATTERN
S313
DETERMINE DEVIATION OF ADJUSTMENT PATTERN WITH DENSITY CLOSEST TO DENSITY A
S311
DETERMINE DEVIATION OF ADJUSTMENT PATTERN WITH DENSITY CLOSEST TO DENSITY A
S314
STORE ADJUSTMENT VALUE IN MEMORY
S307
END

RECORDING APPARATUS AND CONTROL METHOD

BACKGROUND OF THE INVENTION

1. Field of the Invention

The present invention relates to a recording apparatus that records an image on a recording medium by using a recording head for discharging ink, and to a control method of the recording apparatus.

2. Description of the Related Art

In inkjet recording apparatuses, increases in speed and image quality have been demanded. To meet the demand on the increase in image quality, a technique for adjusting a deviation of a dot-recording position (recording position), i.e., a recording-position deviation, is essential, in order to decrease image defect, such as unevenness or stripes of an image, which occurs depending on attachment accuracy of a recording head or which is caused by an assembly error of a recording apparatus.

Such a recording-position deviation may appear between a dot recorded by forward scanning and a dot recorded by backward scanning of the recording head, or between dots recorded by different nozzle arrays. Also, a deviation may appear when a dot recorded by an upstream nozzle group of a nozzle array is recorded at a position deviated from a dot recorded by a downstream nozzle group thereof in a main scanning direction of the recording head in a case where the recording head is attached to the recording apparatus in an inclined manner.

To adjust the recording-position deviation, it is necessary to record a plurality of patterns on a recording medium, to acquire an adjustment value from density information acquired from the patterns, and to obtain a deviation time, at which an ink droplet is discharged, based on the adjustment value. Meanwhile, to record the patterns for acquiring the adjustment value, the plurality of patterns are recorded while a position of a dot (adjustment dot) by a second recording operation is deviated relative to a position of a dot (reference dot) recorded by a first recording operation. For example, to adjust a deviation between a recording position by forward scanning and a recording position by backward scanning, a plurality of patterns are recorded such that a deviation of a position of a dot recorded by backward scanning is changed relative to a position of a dot recorded by forward scanning. Also, to adjust a recording-position deviation caused by inclination of the recording head, a reference dot is recorded by the upstream nozzle group, the recording medium is conveyed, and then an adjustment dot is recorded by the downstream nozzle group. At this time, a plurality of patterns are recorded while a relative deviation between the reference dot and the adjustment dot in the main scanning direction is changed. After the plurality of patterns are recorded, an optical sensor provided in the recording apparatus measures optical characteristics (for example, reflection optical densities) of the patterns to acquire information relating to the optical characteristics of the patterns and to acquire an adjustment value.

Japanese Patent Laid-Open No. 2005-88439 discloses a technique in which an optical sensor reads optical characteristics of a plurality of patterns, so that a deviation between recording positions is adjusted. In particular, the technique is to adjust the recording-position deviation by two operations of rough adjustment and fine adjustment. With this technique, the plurality of patterns are recorded by the rough adjustment and the fine adjustment. An adjustment value is roughly determined by the rough adjustment and then patterns for fine adjustment are recorded with smaller deviations. Thus, an amount of patterns to be recorded can be decreased.

To attain the increase in image quality, it is necessary to adjust various types of recording-position deviations. However, the amount of patterns is increased as the number of types (adjustment items) of the recording-position deviations to be adjusted is increased. Hence, a time required for adjustment and an area of a recording medium to be consumed are increased.

If the adjustment value is roughly determined by the rough adjustment and the plurality of patterns for the fine adjustment are recorded like the technique disclosed in Japanese Patent Laid-Open No. 2005-88439, the amount of patterns to be recorded can be decreased, and the time required for the adjustment and the area of a recording medium to be consumed can be decreased. However, with this technique, a plurality of patterns have to be recorded for each of the rough adjustment and fine adjustment.

SUMMARY OF THE INVENTION

According to an aspect of the invention, a recording apparatus is provided that includes a recording section configured to perform recording on a recording medium by using a recording head configured to discharge ink; and a control section configured to control operation of the recording section by recording a first pattern group by the recording head, the first pattern group being used for determining whether a recording position of the recording head is deviated, reading the recorded first pattern group and determining whether the recording position of the recording head is deviated, when it is determined that the recording position is deviated, recording a second pattern group, which is different from the first pattern group, by the recording head, reading the recorded second pattern group, and setting an adjustment value based on the read result, when it is determined that the recording position is not deviated, setting the adjustment value based on the first pattern group without recording the second pattern group, and adjusting the recording position of the recording head based on the adjustment value set based on the read result or the first pattern group.

Further features of the present invention will become apparent from the following description of exemplary embodiments with reference to the attached drawings.

BRIEF DESCRIPTION OF THE DRAWINGS

FIG. 3 is a flowchart for acquiring an adjustment value of a recording-position deviation.

DESCRIPTION OF THE EMBODIMENTS

In the specification, "recording" includes forming meaningful information such as a character, figure, etc., to form a meaningful or meaningless image, design, pattern, etc., on a recording medium, and to process a medium. A recorded design does not have to be apparent such that a person can visually recognize the recorded design.

Also, "recording media" include a sheet of paper used for a general-purpose recording apparatus, and other materials that can receive ink. The materials may include cloth, a plastic film, a metal plate, glass, ceramic, wood, or leather.

Further, "ink" should be widely interpreted similarly to the definition of "recording," and may be liquid that can be used for forming an image, design, pattern, etc. by applying ink to a recording medium, for processing a recording medium, and for processing ink. Processing the ink includes, for example, to solidify or to insolubilize a coloring agent in the ink to be applied to the recording medium.

Further, a "recording element" (also referred to as "nozzle") usually collectively refers to a discharge port, a liquid passage communicating with the discharge port, and an element for generating energy to be used for ink discharge.

Configuration of Recording Apparatus

Figure 1:
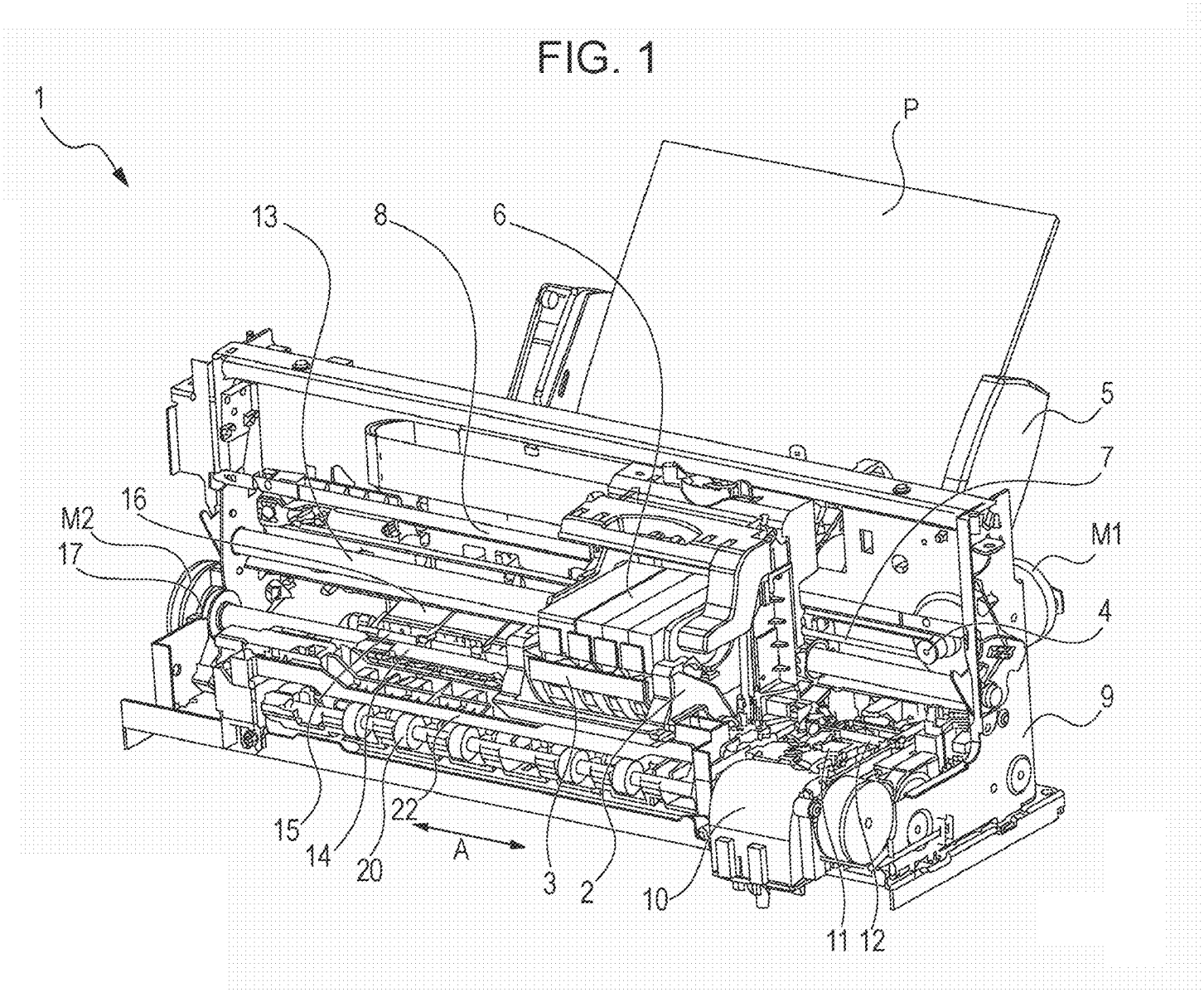
FIG. 1 is an external perspective view showing a recording apparatus to which the present invention is applicable.

FIG. 1 is a perspective view showing an inkjet recording apparatus (hereinafter, also merely referred to as recording apparatus) 1 according to this embodiment. The recording apparatus 1 of this embodiment includes a carriage 2 and a driving mechanism. A recording head 3 can discharge ink, and is detachably attached to the carriage 2. The driving mechanism moves the carriage 2 to perform scanning with the recording head 3. The carriage 2 can reciprocate in a direction indicated by arrow A when a driving force of a carriage motor M1, which serves as a drive source, is transmitted to the carriage 2 through a transmitting mechanism 4. The transmitting mechanism 4 includes a belt, a pulley, etc. An ink cartridge 6 is detachably attached to the carriage 2 to correspond to a type of ink to be used for the recording apparatus 1.

Also, the recording apparatus 1 includes a sheet-feeding mechanism 5. The sheet-feeding mechanism 5 conveys a recording sheet P, which serves as a recording medium, in a direction intersecting with the moving direction of the carriage 2, and intermittently feeds the recording sheet P by a predetermined amount in association with scanning by the recording head 3. Further, the recording apparatus 1 includes a recovery device 10 at an end in a movable range of the carriage 2. The recovery device 10 performs discharge recovery processing of the recording head 3. In this recording apparatus, the recording sheet P is fed to a scanning region of the recording head 3 by a conveying operation of the sheet-feeding mechanism 5, and an image, a character, etc., is recorded on the recording sheet P during scanning with the recording head 3. The carriage 2 is coupled to a part of a driving belt 7, which is included in the transmitting mechanism 4. The transmitting mechanism 4 transmits the driving force of the carriage motor M1. The carriage 2 is guided and supported slidably in the direction indicated by arrow A along a guide shaft 13. Accordingly, the driving force of the carriage motor M1 is transmitted to the carriage 2, and hence the carriage 2 can be moved. In this case, the carriage 2 can be moved in a forward direction or a backward direction by normal rotation or reverse rotation of the carriage motor M1. A scale 8 detects a position of the carriage 2 in the direction indicated by arrow A. In this embodiment, the scale 8 has black bars recorded at a predetermined pitch on a transparent PET film. One side of the scale 8 is fixed to a chassis 9, and the other side is supported by a plate spring (not shown). A sensor (not shown) is provided at the carriage 2, and optically detects the bar of the scale 8, thereby detecting the position of the carriage 2.

A platen (not shown) is provided in a region facing a discharge port array of the recording head 3. During scanning of the recording head 3, recording is performed such that the recording head 3 discharges ink on the recording sheet P whose surface is kept flat by the platen.

The recording head 3 performs recording by generating energy in accordance with a recording signal, and thus selectively discharging ink from a plurality of discharge ports. The recording head 3 of this embodiment is inkjet type in which thermal energy is used to discharge ink. The recording head 3 includes an electrothermal transducer (recording element) that converts electric energy into thermal energy. The thermal energy is applied to the ink, and generates film boiling. Film boiling causes air bubbles in the ink to expand or contract, and changes the pressure of ink. Thus, the ink is discharged from the discharge port. The electrothermal transducer is provided for every discharge port. When a pulse voltage is applied to the electrothermal transducer of every discharge port in accordance with a recording signal, ink is discharged from the corresponding discharge port.

A conveying roller 14 is driven by a conveying-roller motor M2. A pinch roller 15 and the conveying roller 14 pinch the recording sheet P by way of a spring (not shown). A pinch roller holder 16 rotatably supports the pinch roller 15. A roller gear 17 is mounted to an end of the conveying roller 14. The conveying roller 14 is driven by rotation of the conveying-roller motor M2, the rotation being transmitted to the roller gear 17 via an intermediate gear (not shown). A second ejecting roller 20 is driven when rotation of an ejecting-roller motor is transmitted thereto. The second ejecting roller 20 ejects the recording sheet P after recording with the recording head 3, to the outside of the recording apparatus 1. A driven roller (not shown) is pressed to the second ejecting roller 20 by a pressure force of a spring (not shown). The second ejecting roller 20 and the driven roller pinch the recording sheet P. A driven roller holder 22 rotatably supports the driven roller.

The recovery device 10 is arranged at a predetermined position outside a range, in which the carriage 2 reciprocates for a recording operation (e.g., a position corresponding to a home position). The recovery device 10 keeps discharge performance of the recording head 3. The recovery device 10 includes a capping mechanism 11 for capping a surface (discharge surface) with the discharge ports of the recording head 3, and a wiping mechanism 12 for cleaning the discharge surface of the recording head 3. A sucking mechanism (sucking pump etc., not shown) is provided in the recovery device 10 and causes the ink to be forcibly discharged from the discharge ports, in association with capping of the discharge surface with the capping mechanism 11. The discharge recovery processing is performed, for example, by removing thick ink and air bubbles in the discharge ports of the recording head 3. Also, the discharge surface of the recording head 3 is capped when recording is not performed. Accordingly, the recording head 3 can be protected and the ink can be prevented from being dried. The wiping mechanism 12 is arranged near the capping mechanism 11. The wiping mechanism 12 cleans the discharge surface by wiping ink droplets adhering to the discharge surface of the recording head 3. With the capping mechanism 11 and the wiping mechanism 12, the recording head 3 can be kept in a normal discharge condition.

Figure 2:
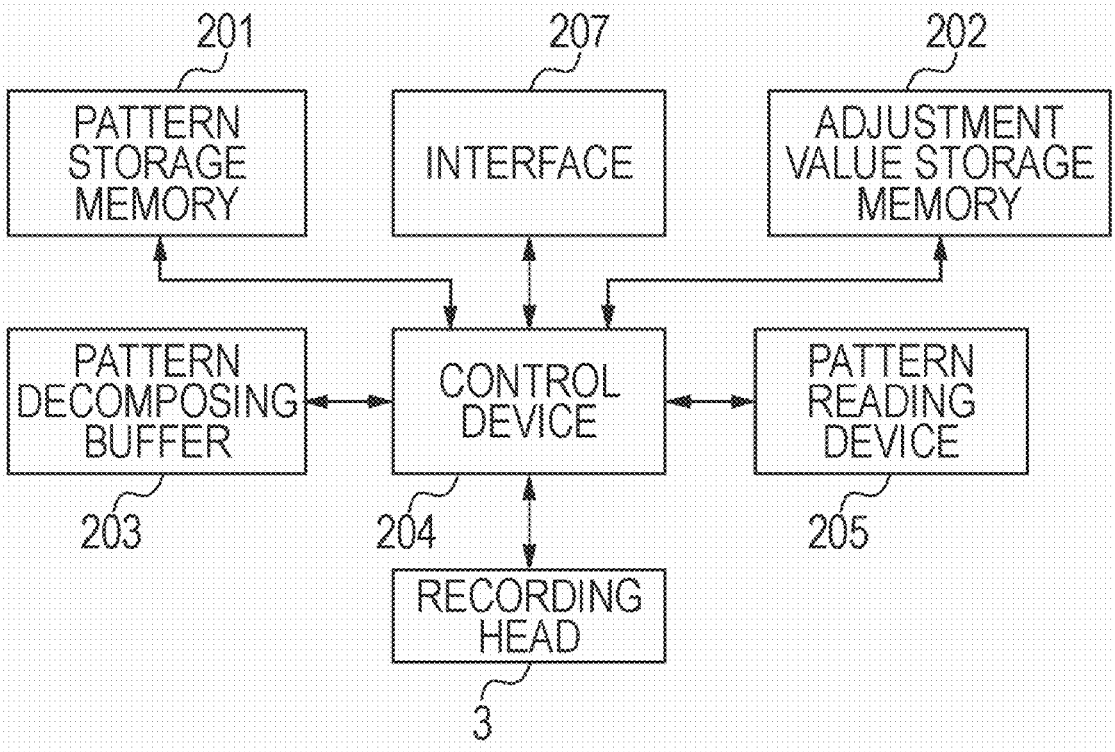
FIG. 2 is a control block diagram showing the recording apparatus to which the present invention is applicable.

FIG. 2 is a control block diagram of the recording apparatus 1. A pattern storage memory 201 stores a reference pattern and an adjustment pattern, which are patterns for adjusting a recording-position deviation. The reference pattern and the adjustment pattern will be described later in detail. The pattern storage memory 201 is a nonvolatile memory (ROM), and is contained in an apparatus main body. Alternatively, the pattern storage memory 201 may be contained in an external device such as a computer, instead of the apparatus main body. In this case, data of the reference pattern and the adjustment pattern stored in the pattern storage memory 201 can be transferred via an interface 207.

An adjustment value storage memory 202 stores an adjustment value for adjusting a recording-position deviation. The adjustment value storage memory 202 is a rewritable nonvolatile memory (EEPROM), and is contained in the apparatus main body. Alternatively, the adjustment value storage memory 202 may be contained in an external device in a similar manner to the pattern storage memory 201. To record recording data desired by a user, the adjustment value stored in the adjustment value storage memory 202 is applied, so that a discharge timing of the recording head 3 is changed and recording is performed. A pattern decomposing buffer 203 is a volatile memory (RAM) that temporarily stores data of a pattern so as to record the pattern stored in the pattern storage memory 201. The pattern decomposing buffer 203 is contained in the apparatus main body. The reference pattern and the adjustment pattern stored in the above-described pattern storage memory 201 are decomposed into the pattern decomposing buffer 203. The recording head 3 records the reference pattern and the adjustment pattern based on the data of the patterns decomposed into the pattern decomposing buffer 203, in response to an instruction of a control device 204.

The control device 204 is contained in the apparatus main body. The control device 204 corresponds to a CPU or a MPU, which performs arithmetic processing, causes respective devices to associate with each other, and controls the entire recording apparatus 1. A pattern reading device 205 is an optical sensor including a light-emitting member and a light-receiving member. The pattern reading device 205 reads the pattern recorded on the recording medium, and converts a density of the read pattern into an electric signal. The pattern reading device (optical sensor) is arranged at, for example, a position located upstream of the recording head 3 in the conveying direction on the carriage 2.

Recording Position Adjustment Control

FIG. 3 is a flowchart for acquiring an adjustment value for a recording-position deviation according to this embodiment. A procedure for acquiring an adjustment value for a recording-position deviation in this embodiment will be described below with reference to FIG. 3.

Figure 4:
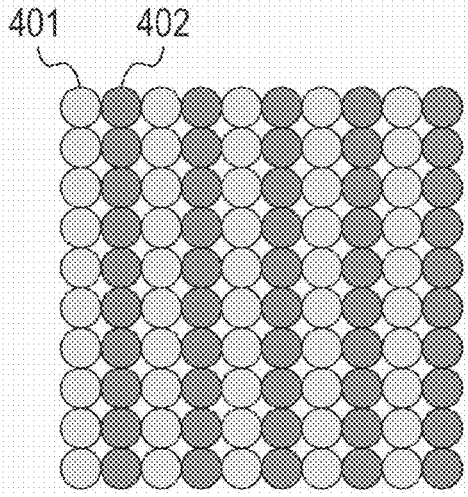
FIG. 4 is an illustration showing a dot arrangement of a reference pattern.

In step S301, a reference pattern is recorded. FIG. 4 is an illustration schematically showing a dot arrangement of the reference pattern. For example, it is assumed that a first recording operation represents recording in a forward direction and a second recording operation represents recording in a backward direction. To adjust a deviation between a recording position by forward scanning and a recording position by backward scanning of the recording head 3, a reference dot 401 and an adjustment dot 402 are recorded in the same scanning direction (forward or backward direction) by the same nozzle array. As long as the above-described condition is satisfied, the reference dot 401 and the adjustment dot 402 may be recorded by a single scanning operation or different scanning operations. Also, to adjust a recording-position deviation caused by inclination of the recording head 3, a reference dot 401 and an adjustment dot 402 are recorded by a nozzle group at an upstream position (or downstream position) of the nozzle array.

When the reference dot 401 and the adjustment dot 402 are recorded as mentioned above, no relative deviation is generated between a position at which the reference dot is recorded and a position at which the adjustment dot is recorded. Hence, the reference pattern is recorded at an ideal dot position. While FIG. 4 shows a pattern as the reference pattern, in which the reference dot 401 is not overlapped with the adjustment dot 402, the reference pattern may be a pattern, in which the reference dot 401 is overlapped with the adjustment dot 402.

Referring back to the flowchart for acquiring the adjustment value in FIG. 3, in step S302, an adjustment pattern is recorded. The adjustment pattern includes the reference dot 401 and the adjustment dot 402; however, a condition for recording the reference dot and the adjustment dot is different from that of the reference pattern. For example, for the adjustment pattern for adjusting a deviation between a recording position by forward scanning and a recording position by backward scanning, the reference dot is recorded by forward scanning of the recording head 3, whereas the adjustment dot is recorded by backward scanning. Also, when a recording-position deviation caused by inclination of the recording head 3 is to be adjusted, the reference dot is recorded by an upstream nozzle group of the nozzle array, whereas the adjustment dot is recorded by a downstream nozzle group (the positional relationship of the upstream side and the downstream side may be reversed).

Further, when the adjustment pattern is recorded in step S302, a deviation S of a recording position of the adjustment dot relative to a recording position of the reference dot is set. The reference dot and the adjustment dot are recorded based on the deviation S. In this embodiment, the deviation S is set to "0".

Describing the deviation in more detail, the deviation is expressed as "+" when the recording position of the adjustment dot is deviated in a forward scanning direction of the recording head 3 relative to the recording position of the reference dot, and the deviation is expressed as "−" when the recording position of the adjustment dot is deviated relative to the recording position of the reference dot in a direction opposite to the forward scanning direction. Also, in the recording apparatus 1 of this embodiment, the recording position of the adjustment dot can be deviated by a unit of 4800 dpi. The degree of the deviation expressed by "1" or "2" represents $1/4800$ or $2/4800$ inch. That is, a deviation expressed by "+2" means that the recording position of the adjustment dot is deviated relative to the recording position of the reference dot by $2/4800$ inch in the forward scanning direction.

In step S303, the pattern reading device 205 measures a density of the reference pattern recorded on the recording medium. In step S304, similarly to step S303, the pattern reading device 205 measures a density of the adjustment pattern recorded on the recording medium. The densities of the reference pattern and the adjustment pattern measured in the respective steps are temporarily stored, and are used for determination of similarity between a density A of the reference pattern and a density B of the adjustment pattern in next step S305. In steps S303 and S304, the measurement of the density of each pattern is desirably measured such that an average density in a relatively wide range is measured and acquired as the density of the pattern.

In step S305, a similarity between the densities (=(density B/density A)×100) is calculated based on the measured density A of the reference pattern and the measured density B of the adjustment pattern. The calculated similarity between the densities of both patterns is compared with a predetermined similarity M(%). It is determined whether the similarity between the densities of both patterns reaches the predetermined similarity M. The determination is performed by a determination expression represented by Expression 1 as follows:

$$M(\%) \leqq (\text{density } B/\text{density } A) \times 100 \quad \text{Expression 1.}$$

If Expression 1 is satisfied, the procedure goes to step S306, in which the deviation S ("0") with which the adjustment pattern is recorded is acquired as the adjustment value. That is, when the similarity between the density A and the density B is M or higher, the adjustment pattern recorded with the deviation S ("0") is recorded at a dot arrangement equivalent to an ideal dot arrangement of the reference pattern. Thus, the deviation S ("0") can be acquired as the adjustment value.

Figure 5A:
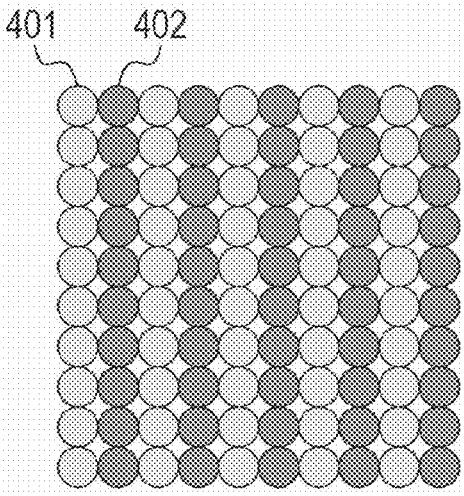
FIGS. 5A and 5B are illustrations showing dot arrangements of adjustment patterns.
Figure 5B:
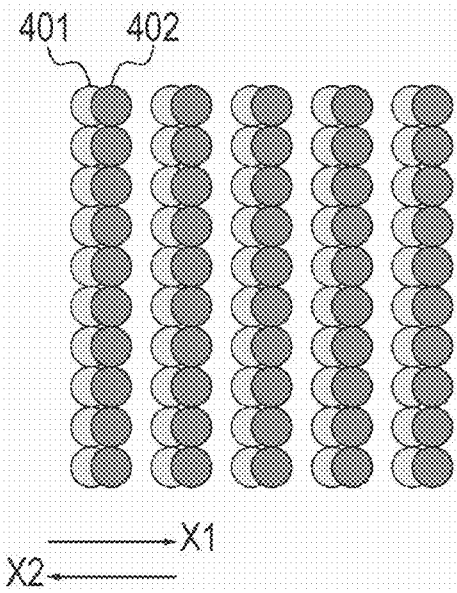

FIGS. 5A and 5B each show a method of adjusting a recording-position deviation based on the deviation (adjustment value). Herein, an example is described, in which a deviation between a recording position by forward scanning (scanning in X1 direction) and a recording position by backward scanning (scanning in X2 direction) of the recording head 3 is adjusted.

FIG. 5A shows a dot arrangement of a reference dot 401 and an adjustment dot 402 in the adjustment pattern recorded with the deviation of "0" when no recording-position deviation is present. Referring to the drawing, if no recording-position deviation is present, the reference dot 401 and the adjustment dot 402 are recorded at ideal positions, and hence, the reference dot 401 and the adjustment dot 402 achieve ideal dot arrangements.

Here, if no recording-position deviation is present, when the deviation is set to "−1", the discharge timing of the recording head 3 is changed, and the adjustment dot 402 recorded by backward scanning is deviated rightward by 1/4800 inch from the ideal recording position. Thus, if no recording-position deviation is present, the adjustment dot 402 is deviated rightward from the ideal recording position as shown in FIG. 5B, and hence, it is expected that the adjustment pattern does not achieve the ideal dot arrangement.

However, when the deviation is set to "−1" and thus the density of the adjustment pattern becomes close to the density of the reference pattern, the adjustment pattern is actually in the ideal dot arrangement. This is because the adjustment dot 402 is deviated leftward by 1/4800 inch from the ideal recording position as a result of the recording-position deviation, and the discharge timing of the recording head 3 is changed such that the recording position is deviated rightward by 1/4800 inch. That is, the recording-position deviation is canceled by the change of the discharge timing. Therefore, the adjustment pattern achieves the ideal dot arrangement.

As described above, when the deviation is set to "−1" and thus the density of the adjustment pattern becomes close to the density of the reference pattern, the discharge timing of the recording head 3 is changed such that the recording position of the dot recorded by backward scanning is deviated rightward by 1/4800 inch.

When the recording-position deviation caused by inclination of the recording head 3 is to be adjusted, for example, the reference dot 401 is recorded by forward scanning (X1) by using the upstream nozzle group, and the adjustment dot 402 is recorded by forward scanning (X1) by using the downstream nozzle group. At this time, when the deviation is set to "−1", the discharge timing is changed such that the adjustment dot 402 is deviated leftward by 1/4800 inch from the ideal recording position.

If no recording-position deviation is present, the adjustment dot 402 is recorded at a position deviated rightward by 1/4800 inch from the ideal recording position, and hence, it is expected that the adjustment pattern does not achieve the ideal dot arrangement. However, when the adjustment pattern has the density close to the density of the reference pattern, the adjustment pattern achieves the ideal dot arrangement. That is, since the adjustment dot 402 is deviated leftward by 1/4800 inch from the ideal recording position as a result of the recording-position deviation, the recording-position deviation is canceled by the change of the discharge timing. Therefore, the adjustment pattern achieves the ideal dot arrangement.

In the flowchart for acquiring the adjustment value in FIG. 3, in step S307, the adjustment value acquired in step S306 is stored in a rewritable nonvolatile memory (EEPROM). Here, the adjustment pattern is recorded by the predetermined deviation S ("0"), and the adjustment value is set to "0" based on the predetermined deviation S ("0") with which the adjustment pattern is recorded. To record image data desired by the user, the adjustment value stored in the above-described nonvolatile memory (EEPROM) is used, so that the discharge timing of the recording head 3 is changed based on the adjustment value and recording is performed.

As described above, in this embodiment, the reference pattern recorded in step S301 and the adjustment pattern recorded in step S302 form a first pattern group for determining whether the recording position is deviated by the predetermined deviation. In this embodiment, the first pattern group (reference pattern and adjustment pattern) is recorded, and it is determined whether the recording position is deviated by the predetermined deviation S ("0"). If it is determined that the recording-position deviation is the deviation S, the recording-position adjustment is completed only with the result of the reference pattern and the single adjustment pattern. Thus, the time required for the adjustment of the recording-position deviation can be decreased, and the area of a recording medium required for recording the patterns can be decreased.

In the similarity determination in step S305, if the similarity between the density A of the reference pattern and the density B of the adjustment pattern does not reach M%, a second similarity determination is performed in step S308. In the second similarity determination in step S308, the similarity between the density A of the reference pattern and the density B of the adjustment pattern is compared with a predetermined similarity N(%) (N<M), to determine whether the similarity between the densities of both patterns reaches the similarity N. The determination is performed by a determination expression represented by Expression 2 as follows:

$$N(\%) \leqq (\text{density } B/\text{density } A) \times 100 \quad \text{Expression 2.}$$

If Expression 2 is satisfied, the procedure goes to step S309, in which adjustment patterns are recorded with a plurality of deviations in a predetermined range (S−k1 to S+k1) around the deviation S ("0") with which the adjustment pattern is recorded. That is, when k1 is set to "1", three adjustment patterns in a range of from "−1" to "1" are recorded. It is noted that since the adjustment pattern with the deviation S ("0") has been already recorded, the adjustment pattern with the deviation S ("0") is not recorded, and the two remaining adjustment patterns are recorded.

In step S310, the pattern reading device 205 measures the density of each adjustment pattern recorded in step S309.

In step S311, the adjustment pattern with the density closest to the density A of the reference pattern is selected from the densities measured in step S310. Then, the deviation with which the selected adjustment pattern is recorded is acquired as the adjustment value. The adjustment value is stored in the EEPROM in step S307.

If the similarity does not reach N% in the second similarity determination in step S308, adjustment patterns in a range of from S−k3 to S−k2, and adjustment patterns in a range of from S+k2 to S+k3 are recorded (k3>k2>k1) in step S312. For example, when k2 is set to "2", and k3 is set to "3", the adjustment patterns with deviations in a range of from "−3" to "−2", and adjustment patterns in a range of from "2" to "3" are recorded. As described above, when the density B of the adjustment pattern recorded with the deviation S is far from the density A of the reference pattern, it is expected that the adjustment value is in a range far from the deviation S. Thus, an adjustment pattern including a deviation in the range far from the deviation S is recorded.

In step S313, similarly to step S310, the pattern reading device 205 measures the density of the adjustment pattern again. At this time, the density measurement of the adjustment pattern with the deviation "0" may be omitted. In step S314, similarly to step S311, the adjustment pattern with the density closest to the density A of the reference pattern is selected from the densities measured in step S313. Then, the deviation with which the selected adjustment pattern is recorded is acquired as the adjustment value. The adjustment value is stored in the EEPROM in step S307. Then, the procedure for acquiring the adjustment value is completed.

As described above, in this embodiment, the reference pattern and the single adjustment pattern are recorded, and it is determined whether the recording position is deviated by the predetermined deviation S ("0"). If it is determined that the recording-position deviation is the deviation S, the recording-position adjustment is completed only with the result of the reference pattern and the single adjustment pattern. Thus, the time required for the adjustment of the recording-position deviation can be decreased, and the area of a recording medium required for recording the patterns can be decreased. That is, in this embodiment, the plurality of adjustment patterns, which form a second pattern group, are recorded only when the recording-position deviation is not the predetermined deviation. Accordingly, the time required for the adjustment and the area of a recording medium required for recording the patterns can be decreased as compared with the recording-position adjustment technique in the past.

In this embodiment, while the similarity determination includes two determinations using two threshold values (similarities) of M and N, similarity determination may include a single determination, or three or more determinations. For example, in a case where a single similarity determination is performed, a deviation with which a first adjustment pattern is recorded may be acquired as an adjustment value if a similarity is a predetermined threshold value or higher, and a plurality of adjustment patterns may be recorded if the similarity is lower than the predetermined threshold value. Also, a range of deviations of adjustment patterns recorded when a similarity is lower than the predetermined threshold value in both first and second similarity determinations may be changed in accordance with adjustment items. While the similarity determination of this embodiment is performed based on a ratio of the density B of the adjustment pattern to the density A of the reference pattern, for example, the determination may be based on whether a difference between the density A and the density B is within a threshold value (predetermined value). Further, in recording-position adjustment control of this embodiment, while the pattern reading device is used to perform the first similarity determination and to select the optimum pattern from the plurality of adjustment patterns, the processing may be executed visually by the user. In this case, for example, the reference pattern and the adjustment pattern may be recorded side by side in steps S301 and S302, and the user may determine whether an image including the two patterns is uniform, thereby detecting whether the recording position is deviated. Also, in step S311 and S314, an adjustment pattern with a density closest to the density A of the reference pattern may be selected from a plurality of adjustment patterns. In the processing, information of the pattern selected by the user is stored in the adjustment value storage memory 202 via an input unit (not shown) of the recording apparatus and a host apparatus.

Also, in step S311 and S314, an adjustment value is determined by selecting the adjustment pattern with the density closest to the density A of the reference pattern from the plurality of adjustment patterns. However, an approximating curve may be calculated from each of the densities of the plurality of adjustment patterns, and an adjustment value may be acquired based on a maximum value and a minimum value of the approximating curve. Further, in this embodiment, the ideal dot arrangement of the reference pattern is set such that the reference dot is not overlapped with the adjustment dot. If the ideal dot arrangement is achieved, the highest reflection optical density can be attained. Alternatively, an ideal dot arrangement may be a dot arrangement in which the reference dot is overlapped with the adjustment dot, and the lowest reflection optical density is acquired. In this embodiment, the deviation S with which the adjustment pattern is recorded first is set to "0." The value S may employ a value which most likely fits the result of the first similarity determination. That is, if it is desired that the deviation S is changed with time, the deviation S may be changed with time lapse. Also, in second or later recording-position adjustment control, the predetermined deviation S may be changed based on the adjustment value stored in the adjustment value storage memory 202 by the previous recording-position adjustment controls.

Figure 6:
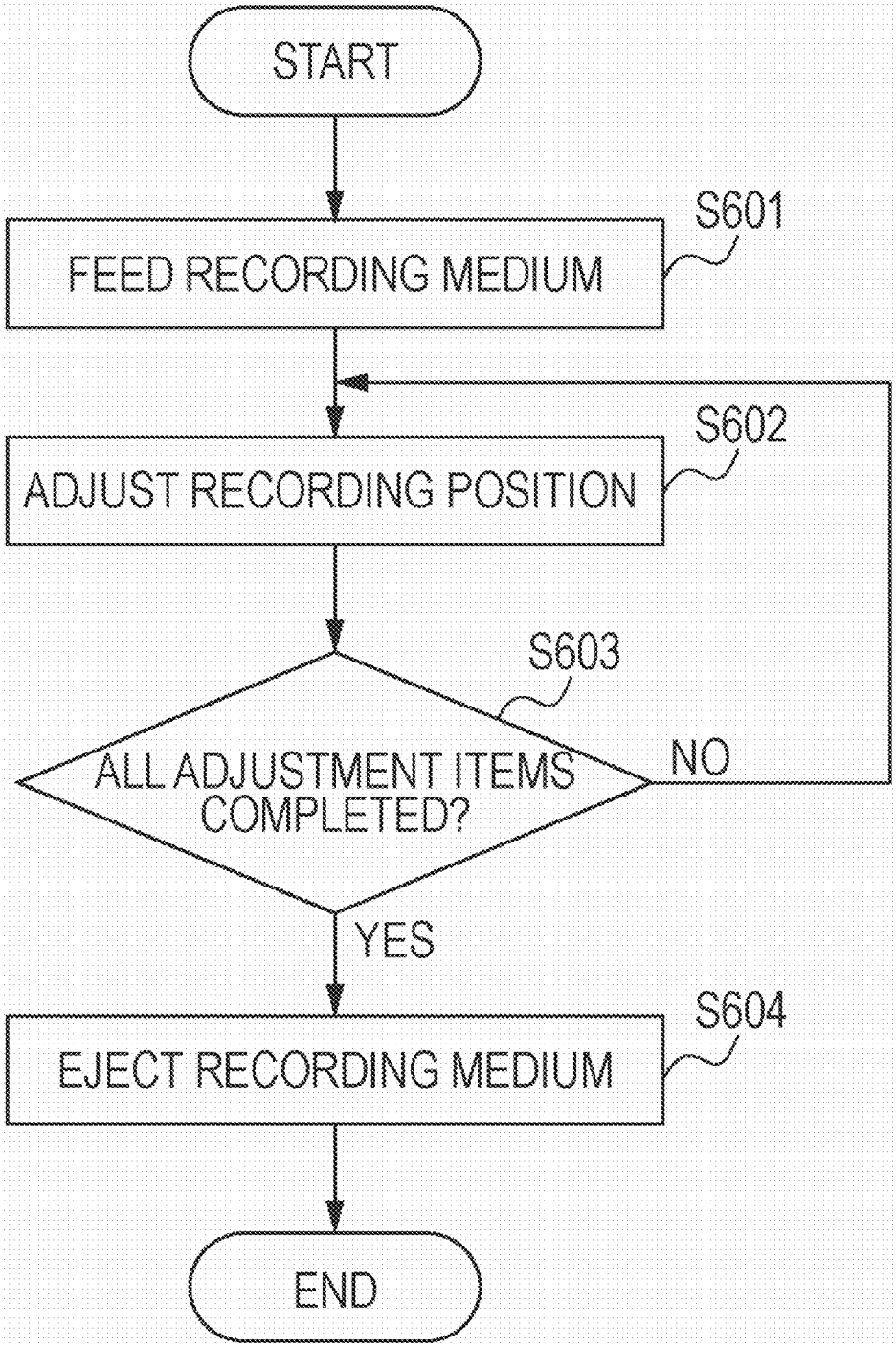
FIG. 6 is a flowchart for a series of operations from sheet feeding to sheet ejecting of a recording sheet.

FIG. 6 shows a flowchart including a series of operations from sheet feeding to sheet ejecting of a recording sheet (recording medium) while the reference pattern and the adjustment pattern are recorded.

In step S601, the recording medium is conveyed by the sheet-feeding mechanism to a position at which a pattern is recorded on the recording medium. Then, in step S602, patterns are recorded and densities of the patterns are measured according to the procedure for acquiring the adjustment value shown in FIG. 3, to acquire adjustment values of necessary adjustment items.

In step S603, when plural types of recording-position deviations are adjusted, it is determined whether acquisition of all types of adjustment values is completed. If it is not completed, a procedure for acquiring an adjustment value for a recording-position deviation, which has not been completed yet, is executed. After all adjustment values for deviations between recording positions are acquired, the procedure goes to step S604, in which the recording medium is conveyed to a sheet ejection port by a sheet-ejecting mechanism. The types of recording-position deviations to be adjusted may be partly omitted in accordance with conditions of the recording apparatus and the recording head, frequency of use, period of use, and the like.

Figure 7A:
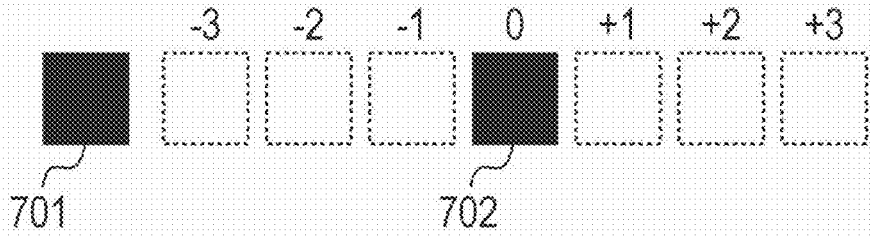
FIGS. 7A to 7C are illustrations showing layouts of reference patterns and adjustment patterns.
Figure 7B:
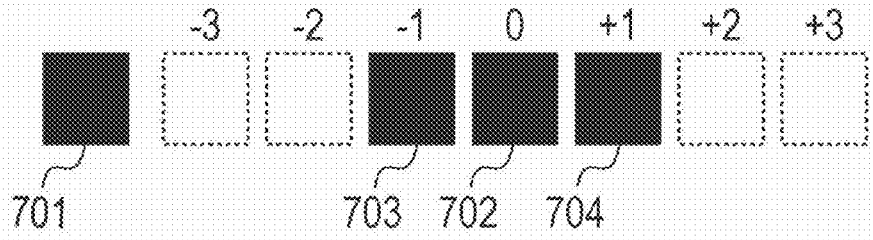
Figure 7C:
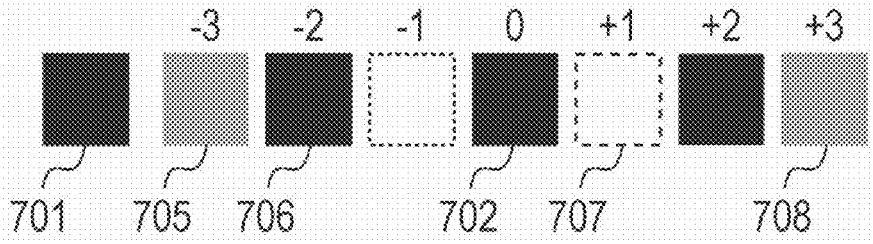

FIGS. 7A to 7C illustrate layouts of reference patterns and adjustment patterns recorded on recording media.

FIG. 7A illustrates a layout of a reference pattern and an adjustment pattern recorded on a recording medium when a similarity between the reference pattern and the adjustment pattern reaches the predetermined similarity M according to the procedure for acquiring the adjustment value shown in FIG. 3. In FIG. 7A, a single reference pattern 701 and a single adjustment pattern 702 are recorded.

FIG. 7B illustrates a layout of a reference pattern and an adjustment pattern recorded on a recording medium when a similarity between the reference pattern and the adjustment pattern reaches the predetermined similarity N. In this case, referring to FIG. 7B, a reference pattern 701, and adjustment patterns 702, 703, and 704 are finally recorded on a recording medium.

FIG. 7C illustrates a layout of a reference pattern and an adjustment pattern recorded on a recording medium when a similarity between the reference pattern and the adjustment pattern does not reach the predetermined similarity M or N by the two similarity determinations. In this case, referring to FIG. 7C, a reference pattern 701, and adjustment patterns 702, 705, 706, 707, and 708 are finally recorded on a recording medium.

In FIGS. 7A to 7C, while the respective adjustment patterns are recorded with numbers representing deviations with which the adjustment patterns are recorded, the numbers representing the deviations do not have to be recorded. In FIGS. 7A to 7C, for easier understanding of the positions at which the adjustment patterns are recorded, numerals representing deviations are provided even for adjustment patterns which are not recorded.

Figure 8A:
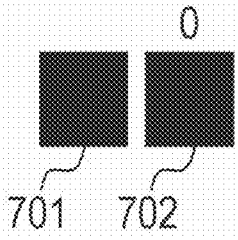
FIGS. 8A to 8C are illustrations showing layouts of reference patterns and adjustment patterns.
Figure 8B:
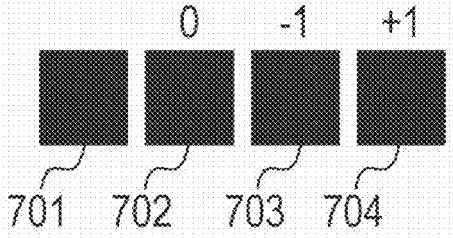
Figure 8C:
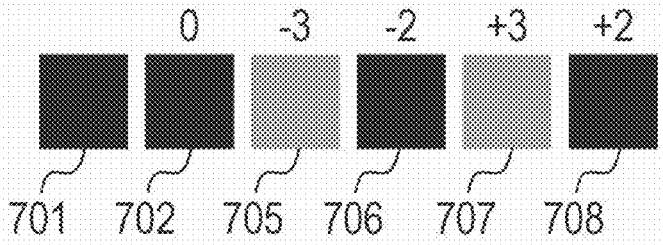

FIGS. 8A to 8C illustrate other layouts of reference patterns and adjustment patterns to be recorded on recording media. FIGS. 8A, 8B, and 8C respectively correspond to FIGS. 7A, 7B, and 7C.

The layouts shown in FIGS. 8A to 8C are different from the layouts in FIGS. 7A to 7C in that the adjustment patterns are not recorded at given positions, but are recorded in a left aligned manner. With the layouts, patterns for adjusting different types of recording-position deviations can be recorded in an unused space. The area of a recording medium required for recording the patterns can be further decreased. The adjustment pattern do not have to be recorded in a left aligned manner, and the alignment side may be the right side, upper side, lower side, or the like, depending on the shape of a pattern, and performance and an attachment position of an optical sensor (reading device). Even with the layouts in FIGS. 7A to 7C, as long as the positions of the patterns recorded on the recording medium are stored, patterns for adjusting different types of recording-position deviations can be recorded in an unused area.

In this embodiment, the reference pattern and the single adjustment pattern are recorded as the first step. Then, as a second step, it is determined whether the recording position is deviated by the predetermined deviation S based on the similarity between the reference pattern and the adjustment pattern. If the recording-position deviation is the predetermined deviation S, the adjustment value is acquired based on the predetermined deviation S without recording an additional adjustment pattern, as a fourth step. Thus, the time required for the adjustment and the area of a recording medium required for recording the patterns can be decreased as compared with the technique of adjusting the recording positions in the past, the technique which is configured to always record a plurality of patterns. If the deviation between the recording positions is not the predetermined deviation S, a plurality of patterns are additionally recorded and an adjustment value is acquired as a third step. For actual recording (fifth step), the ink discharge timing of the recording head is changed based on the adjustment value set in the third or fourth step, and hence, the recording position of the recording head is corrected.

Accordingly, the above-described embodiment of the invention makes it possible to decrease the time required for the adjustment of the recording-position deviation and decrease the area of a recording medium required for recording the patterns.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-160770 filed Jun. 19, 2008, which is hereby incorporated by reference herein in its entirety.

What is claimed is:

1. A recording apparatus, comprising:

a recording section configured to perform recording on a recording medium by using a recording head configured to discharge ink; and a control section configured to control operation of the recording section by recording a first pattern group by the recording head, the first pattern group being used for determining whether a recording position of the recording head is deviated, reading the recorded first pattern group and determining whether the recording position of the recording head is deviated, when it is determined that the recording position is deviated, recording a second pattern group, which is different from the first pattern group, by the recording head, reading the recorded second pattern group, and setting an adjustment value based on the read result, when it is determined that the recording position is not deviated, setting the adjustment value based on the first pattern group without recording the second pattern group, and adjusting the recording position of the recording head based on the adjustment value set based on the read result or the first pattern group.

2. The recording apparatus according to claim 1, further comprising:

a detector configured to optically detect a density of patterns of the first pattern group and a density of patterns of the second pattern group.

3. The recording apparatus according to claim 2, wherein the first pattern group includes a reference pattern which is recorded by a first recording operation of the recording head and adjustment patterns which are recorded by the first recording operation and a second recording operation of the recording head, a position of the adjustment pattern by the second recording operation being deviated with a predetermined deviation.

4. The recording apparatus according to claim 3, wherein, when the recorded first pattern group is read, it is determined whether the recording position is deviated by determining whether a ratio of an optical density of the adjustment pattern to an optical density of the reference pattern is smaller than a predetermined value.

5. The recording apparatus according to claim 4, wherein the second pattern group includes a plurality of adjustment patterns which correspond to a plurality of deviations different from the deviation of the adjustment pattern included in the first pattern group.

6. The recording apparatus according to claim 5, wherein the control section changes a range of the deviations in the second recording operation based on the ratio, the deviations causing the second recording operation to be different from the first recording operation.

7. A control method of a recording apparatus, the apparatus configured to perform recording by using a recording head configured to discharge ink, the method comprising:

recording a first pattern group by the recording head, the first pattern group being used for determining whether a recording position of the recording head is deviated, reading the recorded first pattern group and determining whether the recording position of the recording head is deviated, when it is determined that the recording position is deviated, recording a second pattern group, which is different from the first pattern group, by the recording head, reading the recorded second pattern group, and setting an adjustment value based on the read result, when it is determined that the recording position is not deviated, setting the adjustment value based on the first pattern group without recording the second pattern group, and adjusting the recording position of the recording head based on the adjustment value set based on the read result or the first pattern group.

* * * * *